US006374745B1

(12) United States Patent
Pichlmeier

(10) Patent No.: US 6,374,745 B1
(45) Date of Patent: Apr. 23, 2002

(54) LINE-CHANGING DEVICE FOR TRACKS OF A MAGNETIC LEVITATION TRAIN

(75) Inventor: Franz-Xaver Pichlmeier, Taufkirchen (DE)

(73) Assignee: ThyssenKrupp Technologies AG, Essen (DE)

( * ) Notice: Subject to any disclaimer, the term of this patent is extended or adjusted under 35 U.S.C. 154(b) by 0 days.

(21) Appl. No.: 09/600,222

(22) PCT Filed: Dec. 22, 1998

(86) PCT No.: PCT/EP98/08396

§ 371 Date: Jul. 11, 2000

§ 102(e) Date: Jul. 11, 2000

(87) PCT Pub. No.: WO99/36626

PCT Pub. Date: Jul. 22, 1999

(30) Foreign Application Priority Data

Jan. 14, 1998 (DE) ..... 198 00 908

(51) Int. Cl.[7] ..... B61B 13/08
(52) U.S. Cl. ..... 104/130.02
(58) Field of Search ..... 104/130.01, 130.02, 104/130.03; 246/415 R

(56) References Cited

U.S. PATENT DOCUMENTS

| | | | | |
|---|---|---|---|---|
| 3,964,398 A | * | 6/1976 | Breitling | 104/148 |
| 5,219,395 A | * | 6/1993 | Spieldiener et al. | 104/130 |
| 5,325,789 A | * | 7/1994 | Tapias | 104/130 |
| 5,517,924 A | * | 5/1996 | He et al. | 104/286 |
| 6,279,484 B1 | * | 8/2001 | Shaw | 104/130.01 |

* cited by examiner

*Primary Examiner*—S. Joseph Morano
*Assistant Examiner*—Robert J. McCarry, Jr.
(74) *Attorney, Agent, or Firm*—Max Fogiel

(57) ABSTRACT

The invention relates to a line-changing device for the tracks (1, 2) of a magnetic levitation train. The tracks (1, 2) are formed by track supports arranged one after the other and the lines are changed by means of a rail joint between the tracks (1, 2). To connect the tracks a track support configured as a bendable support (5) is positioned along each track which bendable support can be bent to establish a connection between the tracks (1, 2). In its bent state each bendable support can be positioned in relation to the other bendable support (5). Along each track (1, 2) a track support situated next to the bendable support (5) is configured as a connecting support (6), which when the rail joint is established can be moved out of the clearance gauge of the train. The invention consists in the fact that the connecting supports (6) can be moved without deformation.

7 Claims, 1 Drawing Sheet

LINE-CHANGING DEVICE FOR TRACKS OF A MAGNETIC LEVITATION TRAIN

BACKGROUND OF THE INVENTION

The present invention concerns track-alternating equipment for magnetic-levitation roadways.

One known approach to allowing a change from one magnetic levitation roadway to another adjacent involves special bearers clamped into position at one end at a point of contiguity between two roadways. Each bearer can be inflected toward the other roadway and the bearer accommodated therein. The free ends of the bearers are in alignment, and their midsections follow a prescribed inflection. Several horizontally acting bearer inflecting mechanisms and inflection-maintaining fasteners are accordingly distributed along each bearer between the midsection and the end and can be operated individually or together.

Establishing the bearers' inflection, their "curvature", by means of tabs that act against stops is also known.

German 4 416 819 A1 describes a junction with a bearer that can be inflected resiliently from one roadway toward the other. The inflected ends are in alignment and constitute the junction. The bearer adjoining the resilient end of the other bearer can be resiliently inflected out and away from the adjacent roadway.

This procedure establishes a transition between the roadways even when they are less than twice the open base of the car. This advantage, however, is attained at high engineering expenditure and without decreasing the distance between the roadways all that much.

SUMMARY OF THE INVENTION

The object of the present invention is track-alternating equipment of the aforesaid genus that can be employed to change from one magnetic-levitation roadway to another narrowly adjacent by means of relatively simple engineering.

This object is attained in accordance with the present invention in that the butting bearers are shifted out beyond the open base of the car without being deformed.

One advantage of the present invention is that, since the butting bearers are not subjected to deformation stress when shifted, they will be extensively relieved of material fatigue.

In one practical embodiment of the present invention, the butting bearers are shifted out beyond the open base of the car without being subjected to inflection stress.

In another .practical embodiment of the invention, the butting bearers are shifted out beyond the open base of the car by rotating or pivoting, preferably around a vertical axis.

The end of each butting bearer more remote from the inflectable bearer can be mounted on a rotating bearing with a vertical axis of rotation. The butting bearer can preferably be pivoted on the rotating bearing by one or more horizontally active tabs at a distance from the bearing.

BRIEF DESCRIPTION OF THE DRAWINGS

The present invention will now be specified with reference to the accompanying drawing, wherein.

DESCRIPTION OF THE PREFERRED EMBODIMENTS

Figure 1:
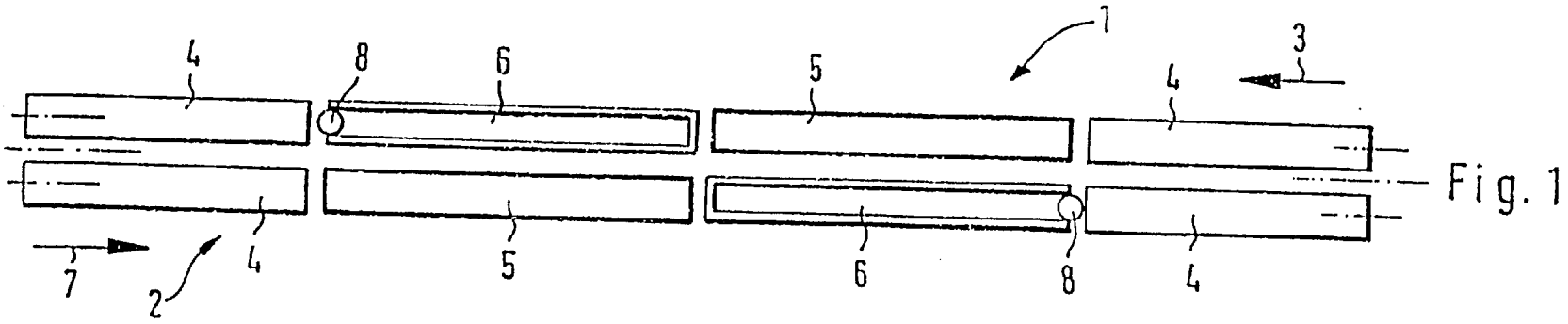
FIG. 1 is a schematic overhead view of two adjacent magnetic levitation roadways and FIG. 2 is a similar view with a junction established between the two roadways.
Figure 2:
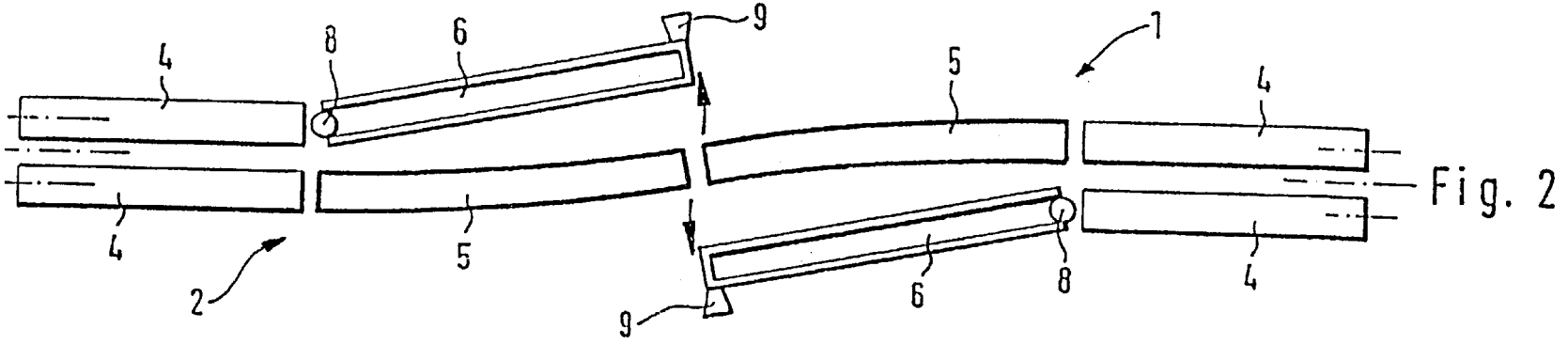

A magnetically levitated car can travel over either of the two roadways 1 and 2 illustrated in FIG. 1. An unillustrated car traveling over roadway 1 in direction 3 will pass over a rigid bearer 4, an inflectable bearer 5, a butting bearer 6, and another rigid bearer 4.

An unillustrated car traveling over roadway 2 in opposing direction 7 on the other hand will pass in the same sequence over a rigid bearer 4, an inflectable bearer 5, a butting bearer 6, and another rigid bearer 4 in that roadway. A car can of course travel over either roadway 1 or roadway 2 in either direction or 7.

How such a junction is established will now be specified. Inflectable-bearers 5, secured at one end, are shifted into the gap between roadways 1 and 2 by in-themselves known motorized mechanisms that act externally and horizontally against bearers 5. Once inflected, the bearers are secured by the same mechanisms and/or by such maintenance mechanisms as bolts.

To ensure sufficient space at the side for the car as it travels over the junction with its open base embracing the roadway, each butting bearer 6 can be pivoted out on a rotating bearing 8 by one or more tabs 9 without being deformed. This feature represents a simple approach to providing enough room for the car to pass while avoiding the stress that would occur on butting bearers 6 if they were simultaneously being deformed.

What is claimed is:

1. A track-alternating arrangement for magnetic-levitation roadways for vehicles having a plurality of sections coupled securely one to another, said vehicles traveling free of contact with said roadways, said track-alternating arrangement comprising: a series of mutually aligned bearers in said roadways; one of said bearers in each roadway for establishing a junction to join the roadways together, said bearer being an inflectable bearer to form said junction; each bearer in an inflected state in one roadway being aligned with another bearer in an adjacent roadway; an abutting one of said bearers adjacent said inflectable bearer and being pivotable about a pivot out beyond a free base of a vehicle traveling over the roadway, said abutting bearer being pivotable without being deformed; said inflectable bearer having a bent shape when establishing said junction and said abutting bearer having a substantially straight-lined unbent shape when pivoted about said pivot and thereby being free of deformation, bending stress and material fatigue, said vehicle being guided by two inflectable bearers receiving continuous deformations for guiding the vehicle uniformly with minimum transitions, transitions to said inflectable bearer and between two inflectable bearers being securely locked, unused bearers being held free of outward deformation, the secure locking being released in a region of said pivot to let the abutting bearer turn outwardly about the pivot.

2. A track-alternating arrangement as defined in claim 1, including rotating means for pivoting said abutting bearers by rotating.

3. A track-alternating arrangement as defined in claim 2, wherein said abutting bearers are pivoted about a vertical axis.

4. A track-alternating arrangement as defined in claim 3, wherein said rotating means comprises a rotating bearing with a vertical axis of rotation, each of said abutting bearers having an end mounted on said rotating bearing remote from the corresponding inflectable bearer.

5. A track-alternating arrangement as defined in claim 4, including at least one horizontally active tab spaced from said rotating bearing for pivoting the abutting bearer.

6. A track-alternating arrangement for magnetic-levitation roadways for vehicles having a plurality of sections coupled securely one to another, said vehicles traveling free of contact with said roadways, said track-alternating arrangement comprising: a series of mutually aligned bearers in said roadways; one of said bearers in each roadway for establishing a junction to join the roadways together, said bearer being an inflectable bearer to form said junction; each bearer in an inflected state in one roadway being aligned with another bearer in an adjacent roadway; an abutting one of said bearers adjacent said inflectable bearer and being pivotable about a pivot out beyond a free base of a vehicle traveling over the roadway, said abutting bearer being pivotable without being deformed; said inflectable bearer having a bent shape when establishing said junction and said abutting bearer having a substantially straight-lined unbent shape when pivoted about said pivot and thereby being free of deformation, bending stress and material fatigue; one first roadway comprising repeated sections of a fixed stationary bearer, an inflectable bearer, and an abutting pivotal bearer; the other second roadway having repeated sections of a fixed stationary bearer lying opposite of said stationary bearer in said first roadway, an abutting bearer lying opposite the inflectable bearer in the first roadway, and an inflectable bearer lying opposite the abutting bearer in the first roadway; a vehicle being movable over said first roadway as well as said second roadway; said junction being formed by inflecting said inflectable bearer through a gap between said first and second roadways; tab means on said abutting bearer for pivoting out each abutting bearer on said pivot to provide sufficient space at a side for said vehicle to pass during travel over said junction with open base of said vehicle embracing the roadway and thereby avoiding stress on the abutting bearers occurring if they were simultaneously deformed; adjacent inflectable bearers being bent to meet at a common point to form a continuous curve for said vehicle to travel over, said vehicle being guided by two inflectable bearers receiving continuous deformations for guiding the vehicle uniformly with minimum transitions, transitions to said inflectable bearer and between two inflectable bearers being securely locked, unused bearers being held free of outward deformation, the secure locking being released in a region of said pivot to let the abutting bearer turn outwardly about the pivot.

7. A track-alternating arrangement as defined in claim 6, wherein said rotating means comprises a rotating bearing with a vertical axis of rotation, each of said abutting bearers having an end mounted on said rotating bearing remote from the corresponding inflectable bearer.

* * * * *